United States Patent [19]

Hack, Jr.

[11] Patent Number: 4,878,474

[45] Date of Patent: Nov. 7, 1989

[54] VENT APPARATUS FOR FUEL INJECTION SYSTEM

[76] Inventor: J. Roy Hack, Jr., 5405 S. Rosemont, Tucson, Ariz. 85706

[21] Appl. No.: 272,902

[22] Filed: Nov. 18, 1988

[51] Int. Cl.[4] ..... F02M 39/00

[52] U.S. Cl. ..... 123/516; 123/456; 123/467

[58] Field of Search ..... 123/516, 514, 456, 452, 123/453, 454-455, 179 L, 467, 459, 458, 457; 137/171, 197

[56] References Cited

U.S. PATENT DOCUMENTS

| | | | |
|---|---|---|---|
| 1,966,032 | 7/1934 | Hasbrouck | 123/516 |
| 1,990,575 | 2/1935 | Vincent | 123/457 |
| 3,402,733 | 9/1968 | McAlvay | 137/197 |
| 3,974,809 | 8/1976 | Stumpp | 123/452 |
| 4,732,131 | 3/1988 | Hensel | 123/516 |

FOREIGN PATENT DOCUMENTS

| | | | |
|---|---|---|---|
| 725135 | 7/1942 | Fed. Rep. of Germany | 137/197 |
| 652622 | 3/1929 | France | 123/516 |
| 0112419 | 9/1929 | Japan | 123/516 |
| 0200663 | 12/1982 | Japan | 123/516 |
| 0048768 | 3/1983 | Japan | 123/516 |
| 126123 | 4/1919 | United Kingdom | 137/171 |

*Primary Examiner*—Carl Stuart Miller

*Attorney, Agent, or Firm*—H. Gordon Shields

[57] ABSTRACT

Vent or bleed apparatus for venting or bleeding air from a fuel injection system includes a manual valve and a solenoid controlled valve. The solenoid controlled valve is remotely operated from within the driver's compartment of a vehicle in which the apparatus is installed. The solenoid controlled valve vents or bleeds the air to a return line which extends from the fuel control system to the fuel tank of the vehicle. The bleed apparatus of the present invention replaces a manual bleed valve installed in fuel injection systems in many vehicles.

11 Claims, 1 Drawing Sheet

VENT APPARATUS FOR FUEL INJECTION SYSTEM

BACKGROUND OF THE INVENTION

1. Field of the Invention

This invention relates to fuel injection systems and, more particularly, to a vent system for venting or bleeding air from fuel injection systems.

2. Description of the Prior Art

In many fuel injection systems, when the engine has run out of fuel, and fuel is replenished in the fuel tank, the fuel pump is not able to cause fuel to flow to the fuel rail, and consequently from the fuel rail to the fuel injectors at the individual cylinders. Rather, the air is compressed in the fuel injection system ahead of the fuel, and, essentially, a high pressure vapor lock occurs.

For venting the fuel injection system, typically there is a manually activated vent valve at the outer end of the fuel rail, beyond the last fuel injector. The valve utilizes a manually actuated valve stem. Depressing the valve stem allows the compressed air to be vented to the atmosphere through the valve. The valve is typically protected by a cap.

In order to actuate the valve, the user of the vehicle typically must have a companion, since two individuals are required. One individual manually actuates the valve and the second individual turns the engine starter over. This also runs the fuel pump. Air is vented from the system while the fuel pump is operating. The venting is typically concluded when fuel is sprayed out of the vent valve.

Obviously, a single individual operating a vehicle typically cannot bleed or vent the air from the engine and crank the engine at the same time. While such a dual function may be accomplished by a single individual with a remote starter button, it is seldom, if ever, that a vehicle owner is so equipped.

The apparatus of the present invention overcomes the prior art by including both a manual valve and a remotely operated solenoid controlled valve to vent or bleed the air from the fuel injection system. Moreover, the air is vented back to the fuel tank, rather than being vented to the atmosphere. This, obviously, prevents hydrocarbons from being emitted into the atmosphere, and accordingly comprises a beneficial result that otherwise is/are, under prior art circumstances, more undesirable hydrocarbon emissions into the atmosphere.

SUMMARY OF THE INVENTION

The invention described and claimed herein comprises a solenoid actuated valve for bleeding air from fuel injection systems and for returning the vented air to the fuel tank of the vehicle in which the fuel injection system is installed. In addition to the solenoid controlled valve, a manual valve is included, or is retained. The apparatus of the present invention replaces the existing manual vent system with the combination of a manual vent or bleed system and a solenoid controlled vent system, and couples the solenoid control system to a return line of the vehicle.

Among the objects of the present invention are the following:

To provide a new and useful bleed system for bleeding air from a fuel injection system;

To provide new and useful apparatus for remotely bleeding air from a fuel injection system;

To provide new and useful solenoid controlled valve apparatus for venting air and hydrocarbon compounds from a fuel injection system to a fuel return line of a vehicle; and To provide new and useful apparatus for replacing a manual valve on a fuel injection system for venting or bleeding the fuel injection system.

DESCRIPTION OF THE PREFERRED EMBODIMENT

Figure 1:
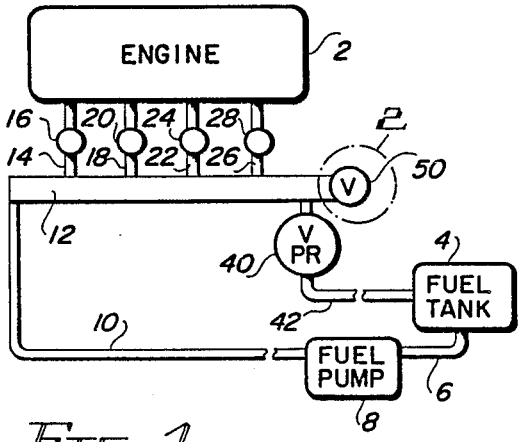
FIG. 1 (PRIOR ART)
FIG. 1 is a top schematic view of an engine with a fuel injection system, typical of the prior art.

FIG. 1 is a top schematic representation of an engine 2 in a motor vehicle. The vehicle also includes a fuel tank 4, and a fuel line 6 extends from a fuel tank 4 to a fuel pump 8. From the fuel pump 8, a fuel line 10 extends to a fuel rail 12 disposed adjacent to the engine 2.

For illustrative purposes, the engine 2 is a four cylinder engine, and accordingly there are four fuel lines extending from the fuel rail 12 to four fuel injectors. The fuel lines include a line 14, a line 18, a line 22, and a line 26. The injectors include an injector 16, an injector 20, an injector 24, and an injector 28. The injector 16 is connected to the fuel line 14, the injector 20 is connected to the fuel line 18, the injector 24 is connected to fuel line 22, and the injector 28 is connected to fuel line 26. Fuel is sprayed directly from the injectors into each of the four cylinders to which the injectors are connected.

At the distal end of the fuel rail 12, or remote from where the fuel line 10 is connected to the fuel rail 12, there is a pressure regulator valve 40. A return line 42 extends from the pressure regulator valve 40 to the fuel tank 4.

The pressure regulator valve 40 is set to unload or to open at a predetermined maximum pressure. Only when the pressure of the fuel in the fuel rail 12 exceeds the predetermined pressure will the regulator valve 40 open to allow the excess pressure, or rather the fuel due to excess pressure, to flow through the return line 42 to the fuel tank 4.

Adjacent to the pressure regulator valve 40, and connected to the distal end of the fuel rail 12, is a manual bleed valve 50.

Figure 2:
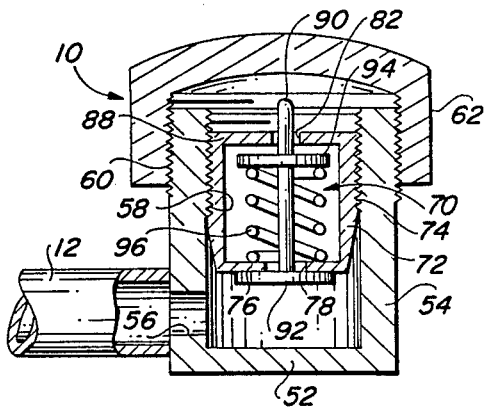
FIG. 2 (PRIOR ART)
FIG. 2 is an enlarged side view in partial section taken generally from circle 2 of FIG. 1.

The manual bleed valve 50 is shown in partial section in FIG. 2. FIG. 2 is a view in partial section through the manual bleed valve 50, taken generally from circle 2 of FIG. 1. The valve 50 is appropriately connected to the fuel rail 12.

The manual bleed valve 50 includes a bottom wall 52 and a cylinder 54 extending upwardly from the bottom wall 52. The cylinder 54 includes an aperture 56. The aperture 56 communicates directly with the fuel rail 12.

The cylinder 54 also includes an internally threaded portion 58 and an externally threaded portion 60. A cap 62 is appropriately secured to the external threads 60.

A valve core 70 is disposed within the cylinder 54. The valve core 70 includes a cylindrical body 72 with an externally threaded portion 74. The external threads 74 of the valve body 72 mate with the internal threads 58 of the cylinder 54 to secure the valve core 70 to the valve cylinder or housing 54.

The cylinder body 72 includes a bottom wall 76 with an aperture 78 extending through the bottom wall. At the top of the cylinder body 72 is a yoke 80. The yoke 80 includes a guide aperture 82 extending through it. The guide aperture 82 is appropriately aligned with the aperture 78.

A valve stem 90 extends through the guide aperture 82 and downwardly into the cylindrical body 72 of the valve core 70. At the bottom of the valve stem 90 is a valve piston 92. The piston 92 is disposed outside of the body 72 and is coaxial with the aperture 78. The diameter of the valve piston 92 is greater than that of the aperture 78. Essentially, the valve piston 92 is a movable valve member, with the area about the aperture 78 comprising a valve seat.

At the upper portion of the stem 90, beneath the yoke 80, is a spring follower 94. A compression spring 96 extends between the bottom wall 76 and the spring follower 94. The compression spring 96 biases the valve stem upwardly to seat the valve piston 92 about the aperture 78.

To manually bleed or vent the valve rail 12, the cap 62 is removed from the cylinder 54, and the valve stem 90 is depressed. Depressing the valve stem 90 causes the piston 92 to move away from the aperture 78, thus allowing air (and hydrocarbon vapor, if any) within the fuel rail 12 to flow outwardly through the aperture 56, the aperture 78, and about the yoke 80 and to the atmosphere.

When the air has been vented from the manual bleed valve 50, and the best indication of the completion of the bleeding procedure is the spurting or squirting of liquid fuel from the valve 50, the valve stem 90 is released. Release of the valve stem 90 causes the valve or piston 92 to close the aperture 78 under the bias of the compression spring 96. The cap 62 is replaced, and normal operation of the engine 2 may resumed.

Figure 3:
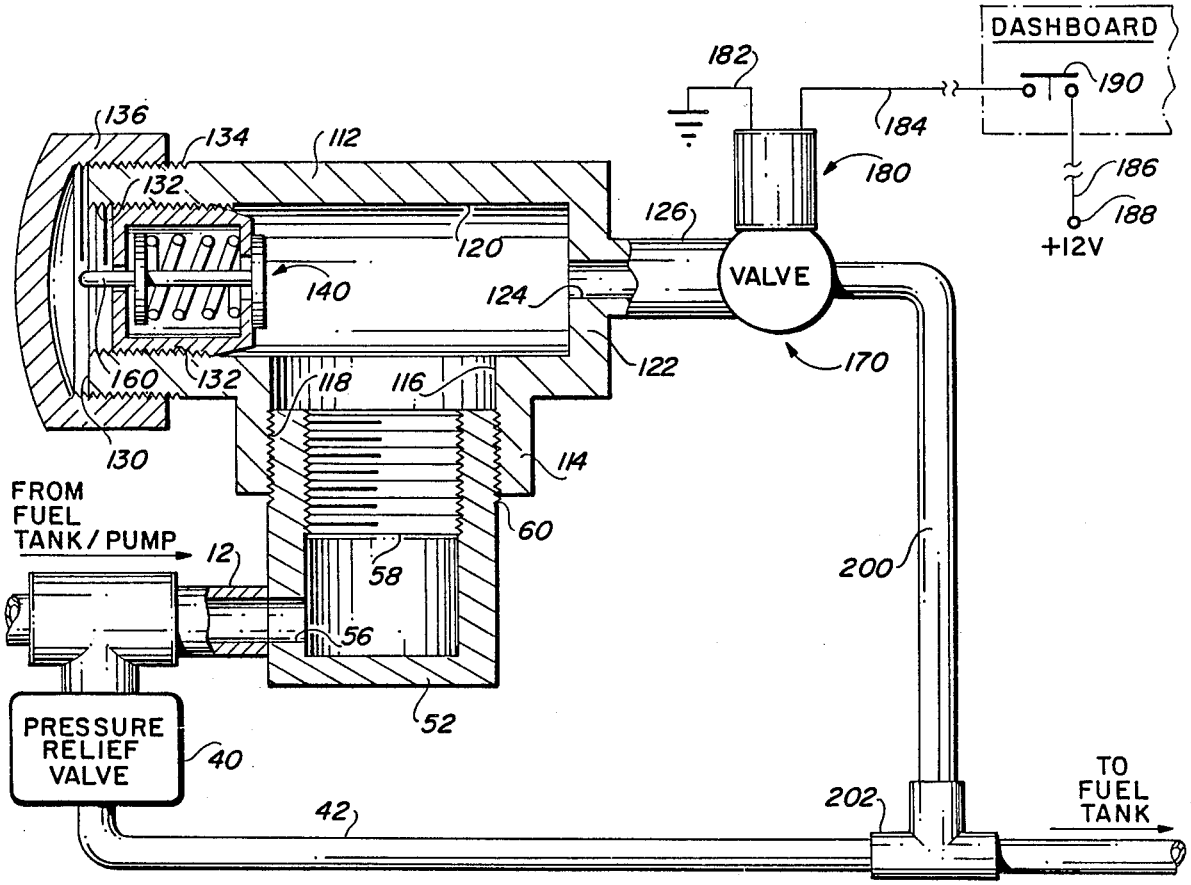
FIG. 3 is an enlarged view in partial section of the apparatus of the present invention in the environment of the apparatus of FIG. 1.

FIG. 3 is an enlarged view in partial section of a portion of the fuel rail 12 and the manual bleed valve 50 with the apparatus of the present invention secured thereto. Also illustrated in FIG. 3 is the pressure relief valve 40 and the return line 42.

The valve core 70, with the valve stem 90 secured thereto, has been removed from the valve cylinder 54. Valve apparatus 110 of the present invention has been secured to the cylinder 54 in place of the removed valve core 70.

The bleeder valve apparatus 110 of the present invention includes a generally cylindrical housing 112. The housing 112 includes a downwardly extending cylindrical connecting portion 114. The connecting portion 114 includes a bore 116, and the bore 116 includes internal threads 118 which mate with the external threads 60 of the cylinder 54.

Within the housing 112 is a cylindrical bore 120. The bore 116 of the cylindrical connecting portion 114 communicates directly with the bore 120. The bore 120 is closed at one end by an end wall 122. The end wall 122 defines the closed end of the housing 112. An aperture 124 extends through the end wall 122 and connects with a bore 128 in a connecting portion 126. The connecting portion 126 extends to a valve 170.

The housing 112 also includes an open outer end 130. Adjacent to the outer end 130 are internal threads 132. The housing 112 also includes external threads 134 at the outer end 130. A cap 136 is secured to the housing 112 on the external threads 134.

A valve core 140, which is substantially identical to the valve core 70, including the stem 90 and its associated elements, is disposed within the cylinder 112 at the internal threads 132. Essentially, the valve core 140 provides manual elements for bleeding the fuel rail 12, if such manual bleeding is desired. However, connected to the valve 170 is a solenoid 180 for remote control of the valve 170, thus bypassing or obviating manual operation of the valve 140.

The solenoid 180 electrically opens the valve 170 to allow for the bleeding or venting of the fuel rail 12 by a user within the vehicle in which the apparatus 110 is installed. The solenoid 180 includes a ground wire 182 to appropriately provide ground connection for the electrical elements which comprise the solenoid 180. A positive conductor 184 extends to a switch 190. The switch 190 is located within the vehicle, preferably on or adjacent to the instrument panel of the vehicle. The switch 190 is a normally opened, spring-biased switch which must be held closed in order to actuate the electrical circuit of the solenoid 180.

A conductor 186 extends from the switch 190 to, ultimately, battery 188. The conductor 186 may be connected through the ignition switch, if desired.

A conduit 200 extends from the valve 170 to a saddle 202. The saddle 202 is appropriately connected to the return line 42. The return line 42, it will be remembered, extends from the pressure relief valve 40 to the fuel tank 4, as shown in FIG. 1. The conduit 200, through the saddle 202, allows the fuel rail 12 to be vented through the valve 170 to the return line 42, thus preventing the hydrocarbon saturated air, bled from the fuel rail 12, from venting to the atmosphere. The apparatus thus helps to prevent polluting hydrocarbons from being vented to the atmosphere.

The saddle 202 includes appropriate elements necessary to puncture the return conduit 42, which is typically made of steel. The saddle 202 also includes its own sealing elements to appropriately seal the saddle 202 directly to the return line 42.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. In a fuel injection system having a fuel rail, a pressure relief valve connected to the fuel rail, a fuel return line extending from the pressure relief valve, and a bleed valve for bleeding air pressure from the fuel rail, including a valve housing connected to the fuel rail and a removable manually actuated valve core, the improvement comprising, in combination:

valve housing means connected to the valve housing for providing a manual bleed valve and a remotely actuable bleed valve;

means for receiving and connecting the manually actuated valve core in and to the valve housing means for providing a manual bleed valve; and remotely actuable valve means connected to the valve housing means for remotely bleeding air pressure from the fuel rail.

2. The apparatus of claim 1 in which the remotely actuable valve means includes a remotely actuable valve and conduit means extending from the remotely actuable valve to the return line for venting the bled air to the return line.

3. The apparatus of claim 1 in which the housing means includes a first portion connected to the valve housing, a second portion connected to the first portion for receiving the manually actuated valve core, and a third portion connected to the first portion, the second portion, and to the remotely actuable valve means.

4. The apparatus of claim 1 in which the remotely actuable valve means includes an electrically actuable solenoid valve, a source of electric current, and a switch connecting the source of electric current to the electrically actuable solenoid valve for remotely actuating the solenoid valve.

5. A fuel injection system including a fuel tank and a fuel rail for receiving fuel from the fuel tank, the improvement comprising, in combination:

valve means connected to the fuel rail for selectively bleeding pressure from the fuel rail, including a first valve manually actuable, a second valve remotely actuable, and housing means for housing the first and second valves; and means for venting pressure from the second valve to the fuel tank.

6. The apparatus of claim 5 in which the remotely actuable valve is selectively actuable for venting the fuel rail to the fuel tank.

7. The apparatus of claim 5 in which the second valve includes an electrically actuable solenoid controlled valve and a switch for electrically and remotely actuating the solenoid.

8. The apparatus of claim 5 in which the housing means includes a first valve housing connected to the fuel rail and a second valve housing connected to the first valve housing, and the first and second valves are disposed in the second valve housing.

9. A method for bleeding a fuel rail of fuel injection system, comprising, in combination, the steps of:

providing a first valve housing for the fuel rail of the fuel injection system;

providing a removable valve core in the first valve housing;

removing the removable valve core from the first valve housing;

providing a second valve housing;

securing the second valve housing to the first valve housing;

securing the removable valve core to the second valve housing to provide a manual bleed valve;

providing a remotely actuable bleed valve; and securing the remotely actuable valve to the second valve housing.

10. The method of claim 9 which further includes the step of providing a fuel return line for the fuel rail.

11. The method of claim 10 which further includes the step of connecting the remotely actuable valve to the fuel return line.

* * * * *